US010849434B1

(12) United States Patent
Gonzalez

(10) Patent No.: US 10,849,434 B1
(45) Date of Patent: Dec. 1, 2020

(54) FOLD-DOWN STAIRS FOR A BUNKBED

(71) Applicant: Alex Gonzalez, Murrieta, CA (US)

(72) Inventor: Alex Gonzalez, Murrieta, CA (US)

( * ) Notice: Subject to any disclaimer, the term of this patent is extended or adjusted under 35 U.S.C. 154(b) by 0 days.

(21) Appl. No.: 16/506,909

(22) Filed: Jul. 9, 2019

(51) Int. Cl.
*A47C 19/22* (2006.01)
*A47C 19/20* (2006.01)
*A47C 21/00* (2006.01)

(52) U.S. Cl.
CPC ..... *A47C 19/22* (2013.01); *A47C 19/20* (2013.01); *A47C 21/00* (2013.01)

(58) Field of Classification Search
CPC ..... A47C 19/20; A47C 19/22; A47C 19/202; A47C 19/207; A47C 17/86; A47C 21/00
USPC ..... 5/9.1, 8, 2.1
See application file for complete search history.

(56) References Cited

U.S. PATENT DOCUMENTS

| | | | | |
|---|---|---|---|---|
| 2,059,240 | A | 7/1934 | Johnston | |
| 2,647,267 | A | 6/1951 | McLaughlin | |
| 4,139,077 | A | 2/1979 | Pena | |
| 4,359,793 | A | 11/1982 | Hosono | |
| 5,003,650 | A | 4/1991 | Caya | |
| 5,768,722 | A | 6/1998 | Olson | |
| D404,214 | S | 1/1999 | Zaidman | |
| 6,314,595 | B1 | 11/2001 | Price | |
| 6,568,001 | B2 | 5/2003 | Walsh | |
| 6,721,969 | B1 | 4/2004 | Lupo | |
| D535,488 | S | 1/2007 | Prillaman | |
| 7,621,236 | B2 * | 11/2009 | Steffey | E06C 1/387 119/847 |
| D611,719 | S | 3/2010 | Everson | |
| 7,832,031 | B1 | 11/2010 | Lupo | |
| 7,971,290 | B2 * | 7/2011 | Woodhams | A47C 19/22 5/9.1 |
| 8,091,294 | B2 * | 1/2012 | Whalen | E06C 1/54 52/183 |
| D653,872 | S | 2/2012 | Chen | |
| 8,136,183 | B1 | 3/2012 | Jannetides | |
| 9,055,824 | B2 * | 6/2015 | Brown | A01K 1/035 |
| 9,226,589 | B2 | 1/2016 | Tully | |
| 9,314,106 | B2 | 4/2016 | Brown | |
| 9,380,760 | B2 * | 7/2016 | Rorke | A01K 1/035 |
| 9,856,654 | B1 * | 1/2018 | Tagart | E06C 1/38 |
| 10,428,531 | B2 * | 10/2019 | Pindrik | E04B 1/3448 |
| 2006/0026754 | A1 | 2/2006 | Ward | |
| 2006/0137266 | A1 * | 6/2006 | Whalen | A01K 1/035 52/183 |
| 2006/0162065 | A1 | 7/2006 | Glattstein | |

(Continued)

*Primary Examiner* — Robert G Santos
(74) *Attorney, Agent, or Firm* — QuickPatents, LLC; Kevin Prince

(57) ABSTRACT

A stairway for a bunk bed supported on a horizontal surface and having an upper bed and a lower bed both supported by four corner supports includes a rear plate fixed with the bunk bed and having two or more step supports. A front plate has two or more inverted step supports and a lower end. Two or more steps are each pivotally fixed with at least one hinge to one of the step supports of the rear plate and, with at least another of the hinges, to a corresponding one of the step supports of the front plate. As such, with the front plate in a lowered position, each step is in a substantially horizontal orientation. With the front plate lifted into a raised position each step pivots into a substantially vertical orientation as the front plate and rear plate meet, preferably in substantially coplanar alignment.

18 Claims, 5 Drawing Sheets

(56) References Cited

U.S. PATENT DOCUMENTS

| | | | | |
|---|---|---|---|---|
| 2008/0302312 | A1* | 12/2008 | Steffey | A01K 1/035 119/849 |
| 2009/0188444 | A1* | 7/2009 | Whalen | E06C 1/387 119/849 |
| 2010/0180379 | A1 | 7/2010 | Leng | |
| 2010/0319120 | A1 | 12/2010 | Woodhams | |
| 2013/0111663 | A1* | 5/2013 | Brown | A47C 21/00 5/507.1 |
| 2014/0123910 | A1* | 5/2014 | Rorke | A01K 1/035 119/849 |
| 2015/0272337 | A1* | 10/2015 | Brown | A47C 21/00 5/507.1 |
| 2017/0245650 | A1 | 8/2017 | Leng | |
| 2019/0093368 | A1 | 3/2019 | Pindrik | |

* cited by examiner

FOLD-DOWN STAIRS FOR A BUNKBED

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to furniture, and more particularly to a bunk bed with a fold-down stairs arrangement.

BACKGROUND

Bunk beds typically include stairs or a ladder in order for the user to reach an upper bed of the bunk bed. Stairways in particular are bulky to store and transport, and as such result in increased shipping and storage costs.

US Patent Application Publication 2019/0093368 to Pindrik on Mar. 28, 2019 teaches a bunk bed stairway that can be folded to reduce its height, but such a device is not able to fold down or collapse in such as way as to reduce its volume.

Therefore, there is a need for a bunk bed stairway that collapses down into a small area when in one configuration, and that can be deployed into a stairway in another configuration. Such a needed device would provide for a safety stop at an uppermost step thereof. Such a needed invention would be relatively inexpensive to manufacture, transport, and store, and would provide a unique and appealing look to the bunk bed The present invention accomplishes these objectives.

SUMMARY OF THE INVENTION

The present device is a stairway for a bunk bed of the type supported on a horizontal surface such as a floor, and having an upper bed and a lower bed. The upper and lower beds are typically each supported by four corner supports. The bunk bed is preferably of the type having two opposing ends and two opposing sides.

The stairway comprises a rear plate fixed with the bunk bed and having two or more step supports. In some embodiments the rear plate includes two of the corner supports preferably at one of the ends of the bunk bed. A front plate has two or more inverted step supports and a lower end.

Two or more steps are each pivotally fixed with at least one hinge, and preferably two or more hinges, to one of the step supports of the rear plate and pivotally fixed with at least one of the hinges to a corresponding one of the step supports of the front plate. Preferably the stairway includes three or four of the steps depending on how tall the upper bed is above the horizontal surface.

As such, with the front plate in a lowered position the lower end of the front plate is supported on the horizontal surface and each step is supported by the step support of the rear plate and the corresponding step support of the front plate in a substantially horizontal orientation. With the front plate lifted into a raised position each step pivots into a substantially vertical orientation as the front plate and rear plate meet, preferably in substantially coplanar alignment.

Preferably the rear plate front plate and steps are all cut from a common wood panel such as ¾" plywood, particle board, MDF, solid wood, or the like. As such, the front plate fits within a cut-out area of the rear plate, and such a cut-out area may take a variety of forms in addition to that shown in the figures.

In some embodiments a back panel is included for fixing between the front plate and the rear plate when the front plate is in the lowered position. The back panel so installed, prevents the front plate from being raised into the raised position and acts as a safety stop at a top-most of the steps. With the back panel removed from the stairway the front plate can be raised into the raised position for compact storage and transport.

In some embodiments, the invention includes the bunk bed and the stairway as a single product. In other embodiments the stairway is sold separately for a pre-existing bunk bed having a bed structure that includes the upper bed the lower bed and the four corner supports.

The present invention is a bunk bed stairway that collapses down into a small volume when in one configuration, and that can be deployed into a stairway in another configuration. The present device provides for a safety stop at an uppermost step thereof, and is relatively inexpensive to manufacture, transport, and store. Further, the present invention lends a unique and appealing appearance to the bunk bed Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
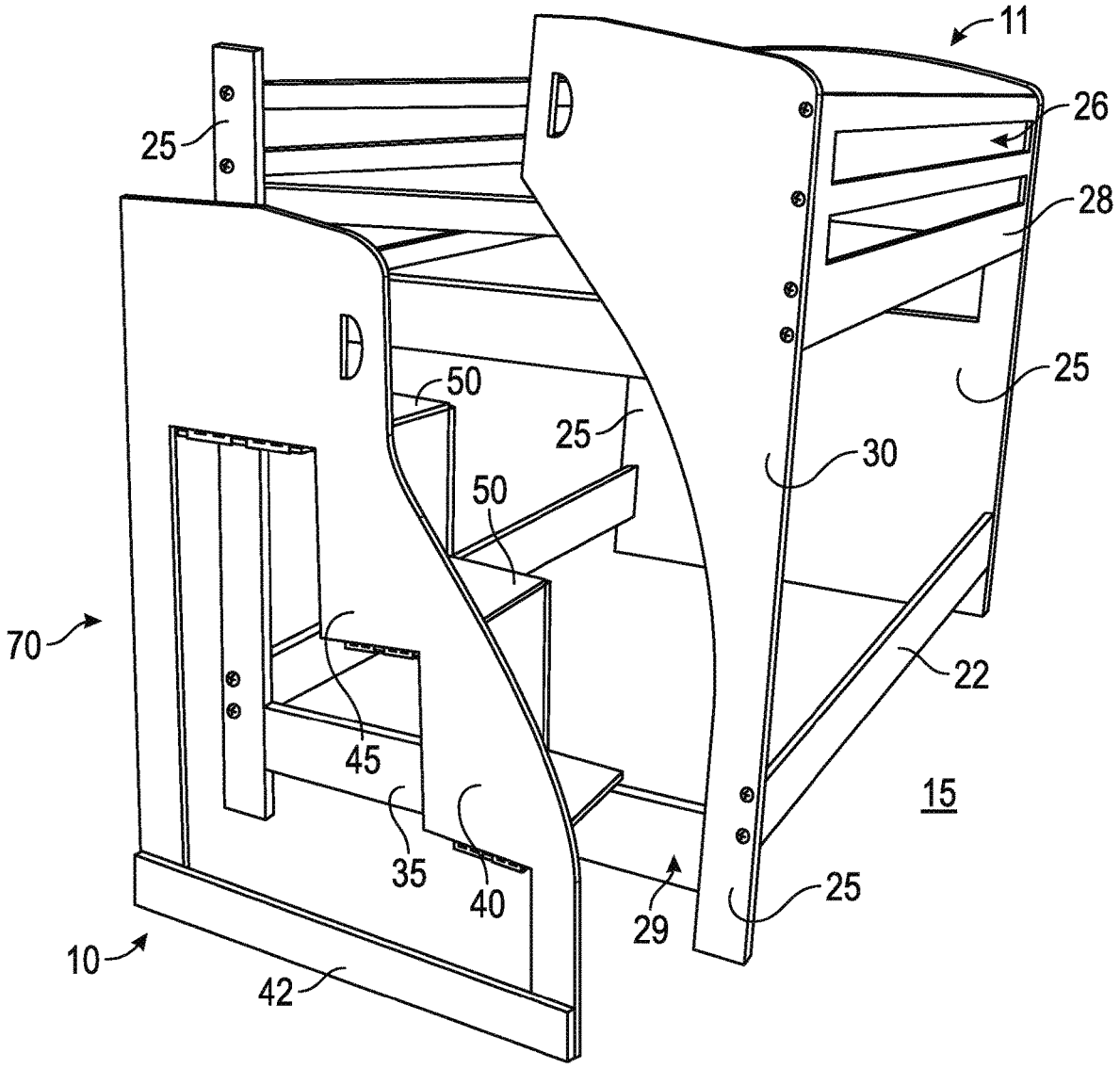
FIG. 1 is a perspective view of the invention, illustrated in a lowered position.
Figure 2:
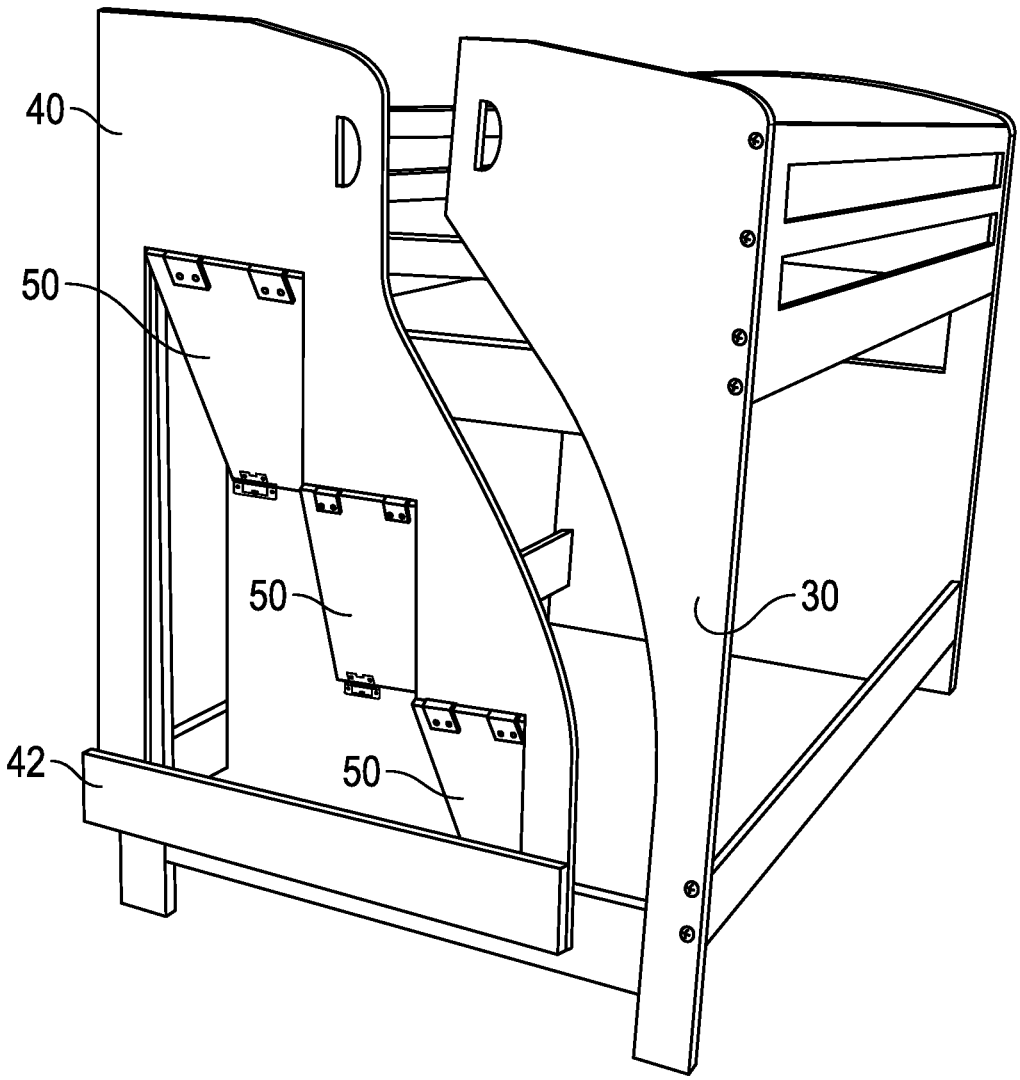
FIG. 2 is a perspective view of the invention, illustrated between the lowered and a raised position.
Figure 3:
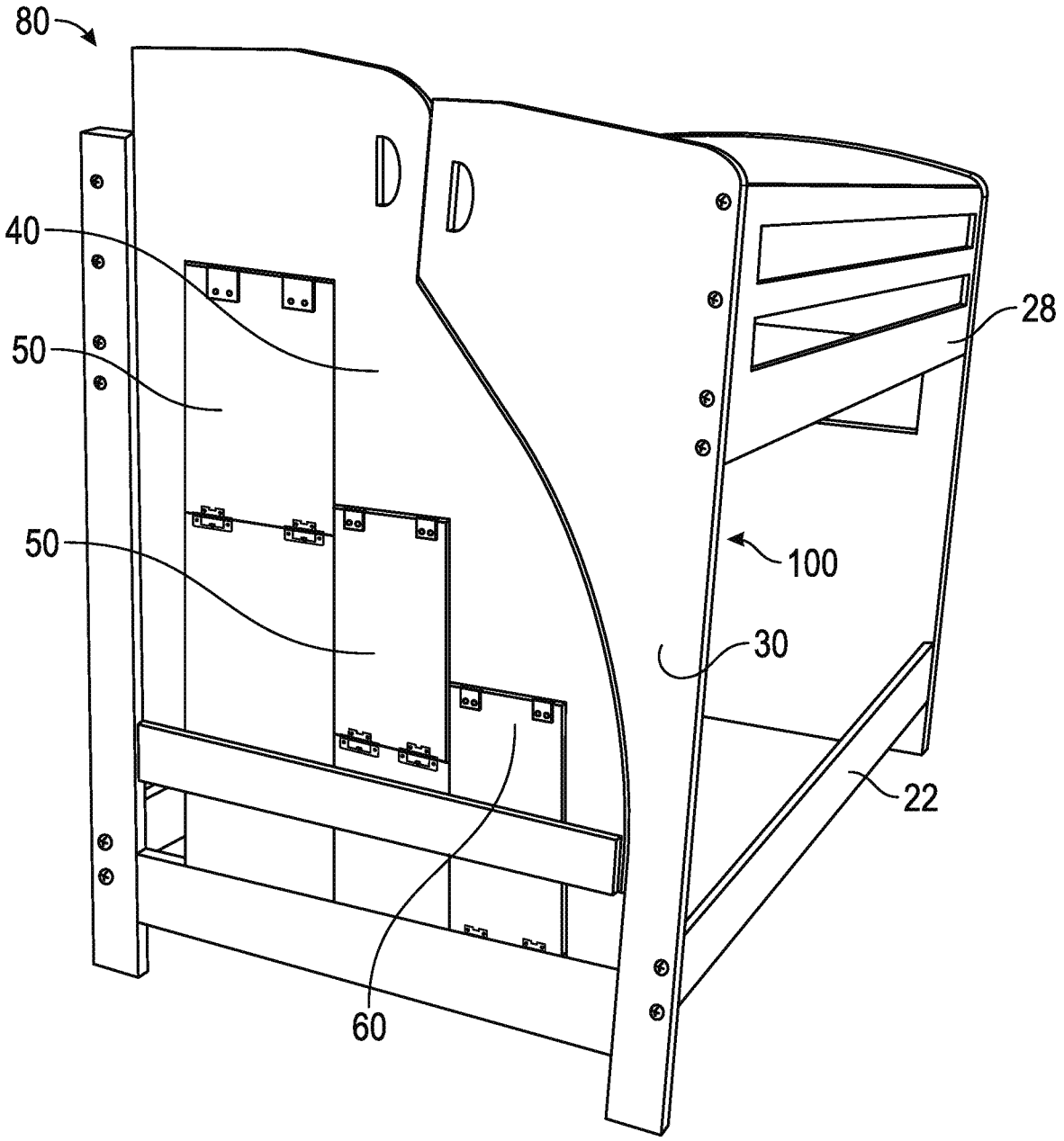
FIG. 3 is a perspective view of the invention, illustrated in the raised position.

FIGS. 1-3 illustrate a stairway 10 for a bunk bed 11 of the type supported on a horizontal surface 15, such as a floor, and having an upper bed 28 and a lower bed 22. The upper and lower beds 28,22 are typically each supported by four corner supports 25. The bunk bed 11 is preferably of the type having two opposing ends 29 and two opposing sides 26.

Figure 4:
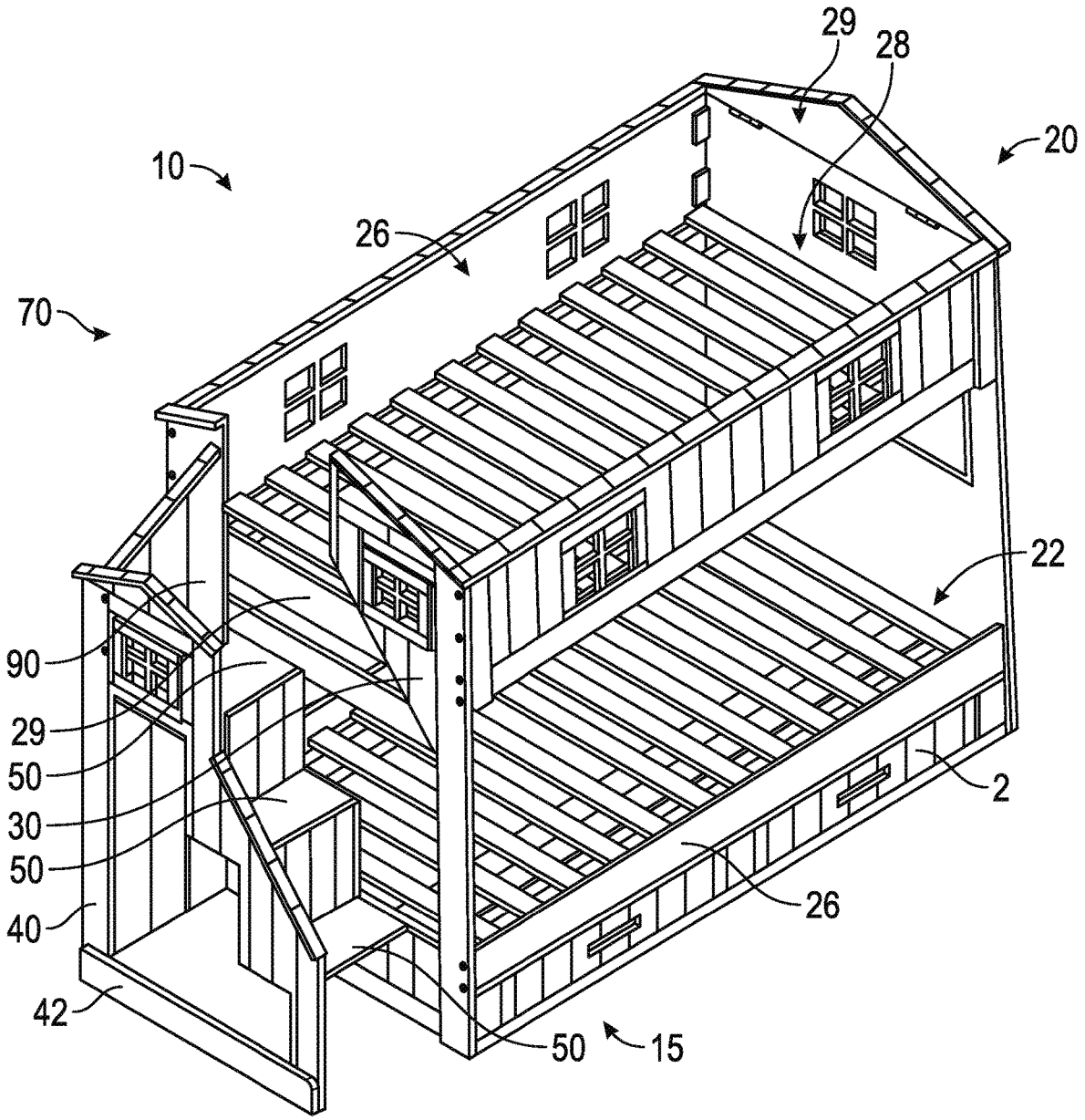
FIG. 4 is a perspective view of an alternate embodiment of the invention.

The stairway 10 comprises a rear plate 30 fixed with the bunk bed 11 and having two or more step supports 35. In some embodiments the rear plate 30 includes two of the corner supports 25 preferably at one of the ends 29 of the bunk bed 11 (FIG. 4).

A front plate 40 has two or more inverted step supports 45 (FIGS. 1 and 5A) and a lower end 42. The rear plate 30 and front plate 40 are preferably made from a rigid sheet material, such as plywood, particle board, MDF, solid wood, or other suitable sheet material.

Figure 5B:
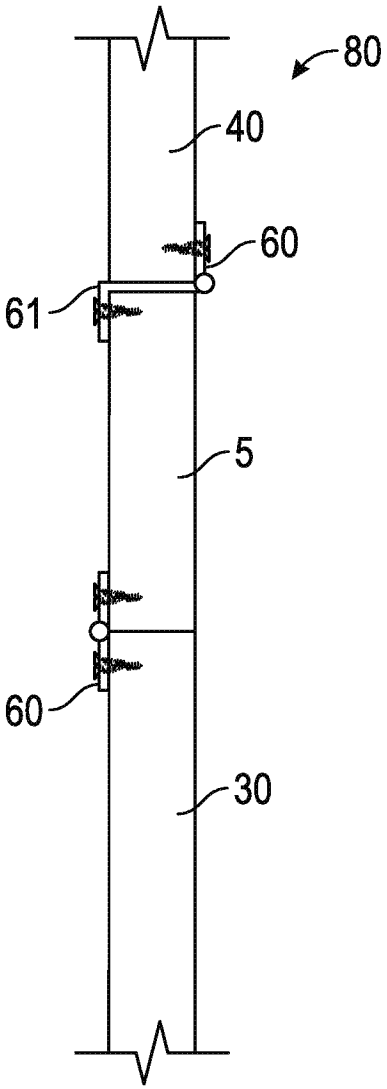
FIG. 5B is a partial side elevational diagram of the rear plate, the step, and the front plate of the invention in the raised position.
Figure 5A:
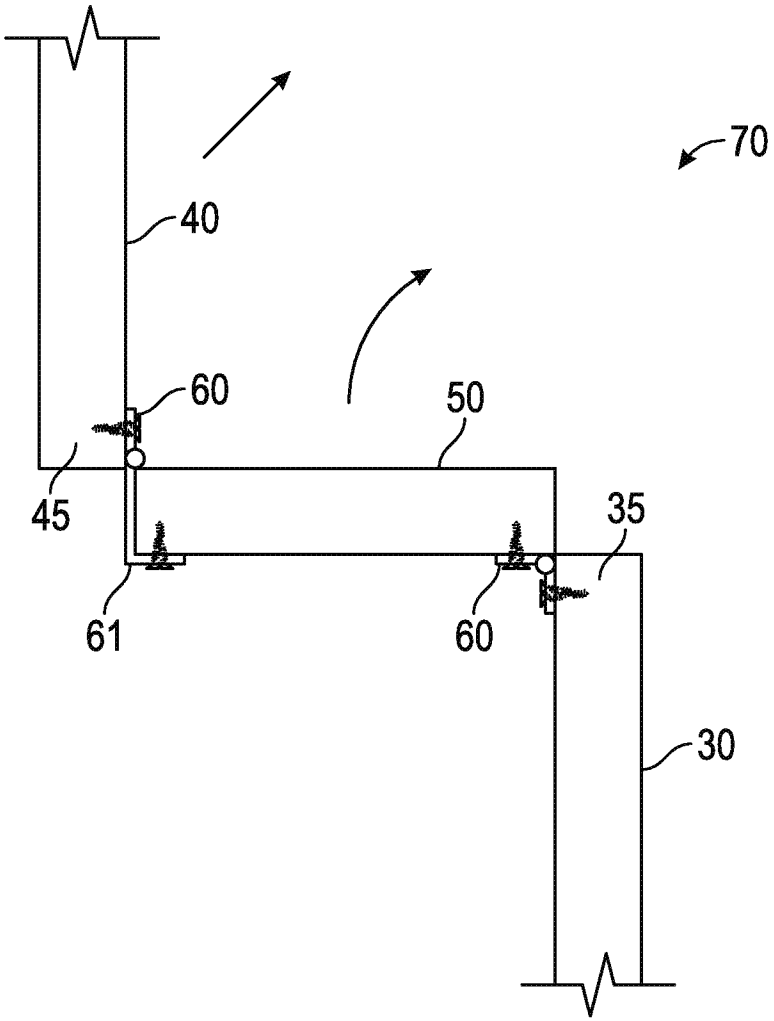
FIG. 5A is a partial side elevational diagram of a rear plate, a step, and a front plate of the invention in the lowered position.

Two or more steps 50 are each pivotally fixed with at least one hinge 60, and preferably two or more hinges 60, to one of the step supports 35 of the rear plate and pivotally fixed with at least one of the hinges 60 to a corresponding one of the step supports 45 of the front plate 40. Preferably the stairway 10 includes three or four of the steps 50, depending on how tall the upper bed 28 is above the horizontal surface 15. The hinges 60 preferably include an L-shaped lower support leg 61 for fixing with a lower side of each step 50 (FIGS. 5A and 5B). The hinges 60 are each made of a strong and rigid metal material.

As such, with the front plate 40 in a lowered position 70, the lower end 42 of the front plate 40 is supported on the horizontal surface 15 and each step 50 is supported by the step support 35 of the rear plate 30 and the corresponding step support 45 of the front plate 40 in a substantially horizontal orientation. With the front plate 40 lifted into a raised position 80, each step 50 pivots into a substantially vertical orientation as the front plate 40 and rear plate 30 meet, preferably in substantially coplanar alignment (FIG. 5B). Preferably the rear plate 30, front plate 40, and steps 50 are all cut from a common wood panel 100, such as ¾" plywood, particle board, MDF, solid wood, acrylic, metal, plastic, or the like. As such, the front plate 40 fits within a cut-out area of the rear plate 30 (FIGS. 2 and 3), and such a cut-out area may take a variety of forms in addition to that shown in FIGS. 1-3.

In some embodiments a back panel 90 (FIG. 4) is included for fixing between the front plate 40 and the rear plate 30 when the front plate 40 is in the lowered position 70. The back panel 90, so installed, prevents the front plate 40 from being raised into the raised position 80 and acts as a safety stop at a top-most of the steps 50. With the back panel 90 removed from the stairway 10, the front plate 40 can be raised into the raised position 80 for compact storage and transport.

In some embodiments, the invention includes the bunk bed 11 and the stairway 10 as a single product. In other embodiments the stairway 10 is sold separately for a pre-existing bunk bed 11 having a bed structure 20 that includes the upper bed 28, the lower bed 22, and the four corner supports 25.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A stairway for a bunk bed of the type supported on a horizontal surface and having an upper bed and a lower bed, the upper and lower beds each supported by four corner supports, the stairway comprising:

a rear plate fixed with the bunk bed and having two or more step supports;

a front plate having two or more inverted step supports and a lower end;

two or more steps, each pivotally fixed with at least one hinge to one of the step supports of the rear plate and pivotally fixed with at least one hinge to a corresponding one of the step supports of the front plate;

whereby in a lowered position the lower end of the front plate is supported on the horizontal surface and each step is supported by the step supports of the front plate and the rear plate in a substantially horizontal orientation, and whereby with the front plate lifted into a raised position each step pivots into a substantially vertical orientation as the front plate and rear plate meet.

2. The stairway of claim 1 wherein the front plate, rear plate and steps are all substantially coplanar when the front plate is in the raised position.

3. The stairway of claim 1 wherein the rear plate is fixed with the bunk bed at an end of the bunk bed.

4. The stairway of claim 3 wherein the rear plate further includes two of the corner supports of the bunk bed.

5. The stairway of claim 1 wherein the rear plate is fixed with the bunk bed at a side of the bunk bed.

6. The stairway of claim 2 wherein the number of steps, step supports of the rear plate, and step supports of the front plate are all exactly three.

7. The stairway of claim 2 further including a back panel adapted for fixing between the front plate and the rear plate when the front plate is in the lowered position to prevent the front plate from being raised into the raised position and to act as a safety stop at a top-most of the steps.

8. The stairway of claim 2 wherein the rear plate, front plate, and steps are all cut from a common wood panel.

9. The stairway of claim 8 wherein the wood panel is taken from the set of wood panels consisting of: plywood, particle board, MDF, or solid wood.

10. A bunk bed supported on a horizontal surface, comprising:

a bed structure having at least an upper bed and a lower bed, the upper and lower beds each supported by four corner supports, each corner support having a lower end adapted for contacting the horizontal surface;

a rear plate fixed with the bunk bed and having two or more step supports;

a front plate having two or more inverted step supports and a lower end;

two or more steps, each pivotally fixed with at least one hinge to one of the step supports of the rear plate and pivotally fixed with at least one hinge to a corresponding one of the step supports of the front plate;

whereby in a lowered position of the front plate the lower end of the front plate is supported on the horizontal surface and each step is supported by the step supports of the front plate and the rear plate in a substantially horizontal orientation, and whereby with the front plate lifted into a raised position each step pivots into a substantially vertical orientation as the front plate and rear plate meet.

11. The bunk bed of claim 10 wherein the front plate, rear plate and steps are all substantially coplanar when the front plate is in the raised position.

12. The stairway of claim 10 wherein the rear plate is fixed with the bunk bed at an end of the bunk bed.

13. The stairway of claim 12 wherein the rear plate further includes two of the corner supports of the bunk bed.

14. The stairway of claim 10 wherein the rear plate is fixed with the bunk bed at a side of the bunk bed.

15. The stairway of claim 11 wherein the number of steps, step supports of the rear plate, and step supports of the front plate are all exactly three.

16. The stairway of claim 11 further including a back panel adapted for fixing between the front plate and the rear plate when the front plate is in the lowered position to prevent the front plate from being raised into the raised position and to act as a safety stop at a top-most of the steps.

17. The stairway of claim 11 wherein the rear plate, front plate, and steps are all cut from a common wood panel.

18. The stairway of claim 17 wherein the wood panel is taken from the set of wood panels consisting of: plywood, particle board, MDF, or solid wood.

* * * * *